US009856807B2

(12) United States Patent
Tsuruoka

(10) Patent No.: US 9,856,807 B2
(45) Date of Patent: Jan. 2, 2018

(54) CONTROL APPARATUS FOR INTERNAL COMBUSTION ENGINE, AND CONTROL METHOD FOR INTERNAL COMBUSTION ENGINE

(71) Applicant: Toyota Jidosha Kabushiki Kaisha, Toyota-shi Aichi-ken (JP)

(72) Inventor: Kazuki Tsuruoka, Miyoshi (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 20 days.

(21) Appl. No.: 15/233,205

(22) Filed: Aug. 10, 2016

(65) Prior Publication Data

US 2017/0051687 A1 Feb. 23, 2017

(30) Foreign Application Priority Data

Aug. 17, 2015 (JP) ..... 2015-160573
Apr. 26, 2016 (JP) ..... 2016-088180

(51) Int. Cl.

*F02D 41/00* (2006.01)
*F02D 41/30* (2006.01)
*F02D 41/02* (2006.01)
*F02D 41/22* (2006.01)

(52) U.S. Cl.

CPC ..... *F02D 41/0085* (2013.01); *F02D 41/221* (2013.01); *F02D 41/3094* (2013.01); *F02D 41/22* (2013.01); *F02D 2041/224* (2013.01); *F02D 2200/06* (2013.01)

(58) Field of Classification Search

CPC .. F02D 41/0085; F02D 41/008; F02D 41/221; F02D 41/3094; F02D 2041/224

USPC ..... 701/103, 104; 123/299, 300, 304, 431, 123/673

See application file for complete search history.

(56) References Cited

U.S. PATENT DOCUMENTS

2009/0099753 A1 4/2009 Kaneko
2012/0247422 A1* 10/2012 Nagakura ..... F02D 41/1454 123/299
2015/0167575 A1* 6/2015 Matsumoto ..... F02D 41/1495 701/102

FOREIGN PATENT DOCUMENTS

JP 2007-056730 A 3/2007
JP 2014-190243 A 10/2014

* cited by examiner

*Primary Examiner* — Mahmoud Gimie
(74) *Attorney, Agent, or Firm* — Dinsmore & Shohl LLP

(57) ABSTRACT

A control apparatus includes an electronic control unit configured to: carry out a first diagnosis and a second diagnosis; control a first injection valve and a second injection valve such that fuel is injected from both the first injection valve and the second injection valve, and such that a fuel injection amount from the second injection valve is not reduced and a fuel injection amount from the first injection valve is reduced, when carrying out the first diagnosis; and control the first injection valve such that fuel is not injected from the first injection valve, and control the second injection valve such that the fuel injection amount from the second injection valve is reduced in a state where fuel is injected from the second injection valve, when carrying out the second diagnosis.

5 Claims, 5 Drawing Sheets

CONTROL APPARATUS FOR INTERNAL COMBUSTION ENGINE, AND CONTROL METHOD FOR INTERNAL COMBUSTION ENGINE

CROSS-REFERENCE TO RELATED APPLICATIONS

This application claims priority to Japanese Patent Application No.

2015-160573 filed on Aug. 17, 2015 and to Japanese Patent Application No. 2016-088180 filed on Apr. 26, 2016, the entire contents of which are hereby incorporated by reference.

BACKGROUND

1. Technical Field

The disclosure relates to a control apparatus for an internal combustion engine and a control method for an internal combustion engine, which are applied to a multi-cylinder internal combustion engine in which a first injection valve and a second injection valve are provided for each cylinder.

2. Description of Related Art

Japanese Patent Application Publication No. 2014-190243 (JP 20141 90243 A) describes a multi-cylinder internal combustion engine in which a first injection valve and a second injection valve are provided for each cylinder. Each first injection valve injects fuel into an intake passage. Each second injection valve injects fuel into a corresponding one of combustion chambers. A control apparatus for such a multi-cylinder internal combustion engine is configured to detect the degree of inter-cylinder imbalance in the amount of fuel supplied to each cylinder.

For example, as a method of detecting the above-described degree of inter-cylinder imbalance, there is known a method in which one of cylinders is set as a target cylinder and a required amount of fuel supplied into the target cylinder is reduced by a predetermined percentage. In this method, by monitoring a mode in which the rotation speed of an engine output shaft changes as a result of reducing the amount of fuel supplied into the target cylinder, the degree of inter-cylinder imbalance in the amount of fuel supplied into each cylinder is detected.

SUMMARY

Incidentally, when there is a malfunction in at least one of fuel injection from the first injection valve and fuel injection from the second injection valve, the degree of inter-cylinder imbalance in the amount of fuel supplied into each cylinder increases. For this reason, a first diagnosis that is a diagnosis of whether there is a malfunction in fuel injection from the first injection valve and a second diagnosis that is a diagnosis of whether there is a malfunction in fuel injection from the second injection valve are individually carried out.

For example, in the second diagnosis, in a state where fuel is not injected from the first injection valve and fuel is injected from the second injection valve, a required fuel injection amount from the second injection valve is reduced by a predetermined percentage.

On the other hand, the first diagnosis is carried out in a state where fuel is injected from both the first injection valve and the second injection valve. For example, such a first diagnosis is carried out in a state where a fuel injection amount from the first injection valve is larger than a fuel injection amount from the second injection valve. When a required fuel injection amount into the target cylinder is reduced by the predetermined percentage, a required fuel injection amount from the first injection valve is reduced by the predetermined percentage, and a required fuel injection amount from the second injection valve is reduced by the predetermined percentage, as shown in FIG. 6. When the required fuel injection amount from the second injection valve is reduced in this way, the required fuel injection amount may become smaller than a minimum injection amount Fmin in terms of the performance of the second injection valve, so it may not be possible to appropriately control the fuel injection amount from the second injection valve.

The disclosure provides a control apparatus for an internal combustion engine and a control method for an internal combustion engine, which are configured to carry out a diagnosis of whether there is a malfunction in fuel injection from a first injection valve that injects fuel into an intake passage without deteriorating the controllability of a second injection valve that injects fuel into a corresponding one of combustion chambers.

According to one aspect of the disclosure, a control apparatus for an internal combustion engine is provided. The internal combustion engine includes a plurality of cylinders, a first injection valve configured to inject fuel into an intake passage, and a second injection valve configured to inject fuel into a corresponding one of combustion chambers. The first injection valve and the second injection valve are provided for each cylinder. The control apparatus includes an electronic control unit. The electronic control unit is configured to carry out a first diagnosis and a second diagnosis in order to detect the degree of inter-cylinder imbalance in the amount of fuel supplied into each cylinder. The first injection valve of a target cylinder that is one of the plurality of cylinders is diagnosed through the first diagnosis, and the second injection valve of the target cylinder is diagnosed through the second diagnosis. The electronic control unit is configured to, in detecting the degree of the inter-cylinder imbalance, control the first injection valve of the target cylinder and the second injection valve of the target cylinder such that the amount of fuel supplied into the target cylinder is reduced. The electronic control unit is configured to, when carrying out the first diagnosis, control the first injection valve of the target cylinder and the second injection valve of the target cylinder such that fuel is injected from both the first injection valve and the second injection valve. The electronic control unit is configured to, when carrying out the first diagnosis, control the first injection valve of the target cylinder and the second injection valve of the target cylinder such that a fuel injection amount from the second injection valve is not reduced and a fuel injection amount from the first injection valve is reduced. The electronic control unit is configured to, when carrying out the second diagnosis, control the first injection valve of the target cylinder such that fuel is not injected from the first injection valve. The electronic control unit is configured to, when carrying out the second diagnosis, control the second injection valve of the target cylinder such that the fuel injection amount from the second injection valve is reduced in a state where fuel is injected from the second injection valve.

With the above configuration, in the first diagnosis, the fuel injection amount from the first injection valve of the target cylinder is reduced, but the fuel injection amount from the second injection valve of the target cylinder is not reduced. For this reason, in carrying out the first diagnosis, it is possible to avoid a situation that a required fuel injection amount from the second injection valve becomes smaller than a minimum injection amount in terms of the performance of the second injection valve. Therefore, it is possible to carry out a diagnosis of whether there is a malfunction in fuel injection from the first injection valve that injects fuel into the intake passage without deteriorating the controllability of the second injection valve that injects fuel into the corresponding one of the combustion chambers.

The control apparatus is configured to carry out the second diagnosis by reducing the fuel injection amount from the second injection valve by a predetermined percentage in a state where fuel is not injected from the first injection valve of the target cylinder and fuel is injected from the second injection valve of the target cylinder.

It is assumed that the first diagnosis is carried out by not reducing the fuel injection amount from the second injection valve but reducing the fuel injection amount from the first injection valve by the predetermined percentage in a state where fuel is injected from both the first injection valve of the target cylinder and the second injection valve of the target cylinder. In this case, the amount of reduction in the amount of fuel supplied into the target cylinder reduces by the amount by which the fuel injection amount from the second injection valve is not reduced. As a result, it becomes difficult to detect a change in determination parameter for determining whether the degree of inter-cylinder imbalance in the amount of fuel supplied into each cylinder is large.

According to the above described aspect, the electronic control unit may be configured to, in carrying out the second diagnosis, control the second injection valve of the target cylinder such that the fuel injection amount from the second injection valve is reduced by a predetermined percentage, and the electronic control unit may be configured to, in carrying out the first diagnosis, control the first injection valve of the target cylinder and the second injection valve of the target cylinder such that the fuel injection amount from the second injection valve is not reduced and the fuel injection amount from the first injection valve is reduced by a corrected percentage obtained by correcting the predetermined percentage to increase.

With the above configuration, in the first diagnosis, the fuel injection amount from the first injection valve of the target cylinder is reduced by the corrected percentage larger than the predetermined percentage. Thus, it is possible to increase the amount of reduction in the amount of fuel supplied into the target cylinder without reducing the fuel injection amount from the second injection valve of the target cylinder. As a result, the determination parameter for determining whether the degree of inter-cylinder variations in the amount of fuel supplied into each cylinder is large changes by a large amount, so it is possible to accurately carry out a diagnosis of whether there is a malfunction in fuel injection from the first injection valve. Therefore, it is possible to accurately carry out a diagnosis of whether there is a malfunction in fuel injection from the first injection valve that injects fuel into the intake passage without deteriorating the controllability of the second injection valve that injects fuel into the corresponding one of the combustion chambers.

According to the above described aspect, the electronic control unit may be configured to calculate an injection distribution ratio. The injection distribution ratio is obtained by dividing the fuel injection amount from the first injection valve by the sum of the fuel injection amount from the first injection valve and the fuel injection amount from the second injection valve. The corrected percentage is obtained by dividing the predetermined percentage by the injection distribution ratio. With this configuration, at the time of carrying out the first diagnosis, the fuel injection amount from the first injection valve is reduced by the thus calculated corrected percentage. For this reason, it is possible to bring the amount of reduction in the amount of fuel supplied into the target cylinder at the time of carrying out the first diagnosis close to the amount of reduction in the amount of fuel supplied into the target cylinder at the time of carrying out the second diagnosis. For this reason, it is possible to make the accuracy of the first diagnosis equal to the accuracy of the second diagnosis.

According to the above described aspect, the electronic control unit may be configured to carry out the first diagnosis in a state where the fuel injection amount from the first injection valve is larger than the fuel injection amount from the second injection valve. With this configuration, in comparison with the case where the first diagnosis is carried out in a state where the fuel injection amount from the first injection valve is smaller than the fuel injection amount from the second injection valve, the amount of reduction in the amount of fuel supplied into the target cylinder at the time of carrying out the first diagnosis increases. For this reason, it is possible to accurately carry out the first diagnosis.

According to another aspect of the disclosure, a control method for an internal combustion engine is provided. The internal combustion engine includes a plurality of cylinders, a first injection valve configured to inject fuel into an intake passage, and a second injection valve configured to inject fuel into a corresponding one of combustion chambers. The first injection valve and the second injection valve are provided for each cylinder. The control method includes: carrying out, by an electronic control unit, a first diagnosis and a second diagnosis in order to detect the degree of inter-cylinder variations in the amount of fuel supplied into each cylinder, the first injection valve of a target cylinder that is one of the plurality of cylinders being diagnosed through the first diagnosis, the second injection valve of the target cylinder being diagnosed through the second diagnosis; and, at the time of detecting the degree of the inter-cylinder variations, controlling, by the electronic control unit, the first injection valve of the target cylinder and the second injection valve of the target cylinder such that the amount of fuel supplied into the target cylinder is reduced. At the time of carrying out the first diagnosis, the first injection valve and the second injection valve are controlled by the electronic control unit such that fuel is injected from both the first injection valve and the second injection valve. At the time of carrying out the first diagnosis, the first injection valve and the second injection valve are controlled by the electronic control unit such that a fuel injection amount from the second injection valve is not reduced and a fuel injection amount from the first injection valve is reduced. At the time of carrying out the second diagnosis, the first injection valve of the target cylinder is controlled by the electronic control unit such that fuel is not injected from the first injection valve. At the time of carrying out the second diagnosis, the second injection valve of the target cylinder is controlled by the electronic control unit such that the fuel injection amount from the second injection valve is reduced in a state where fuel is injected from the second injection valve.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Figure 1:
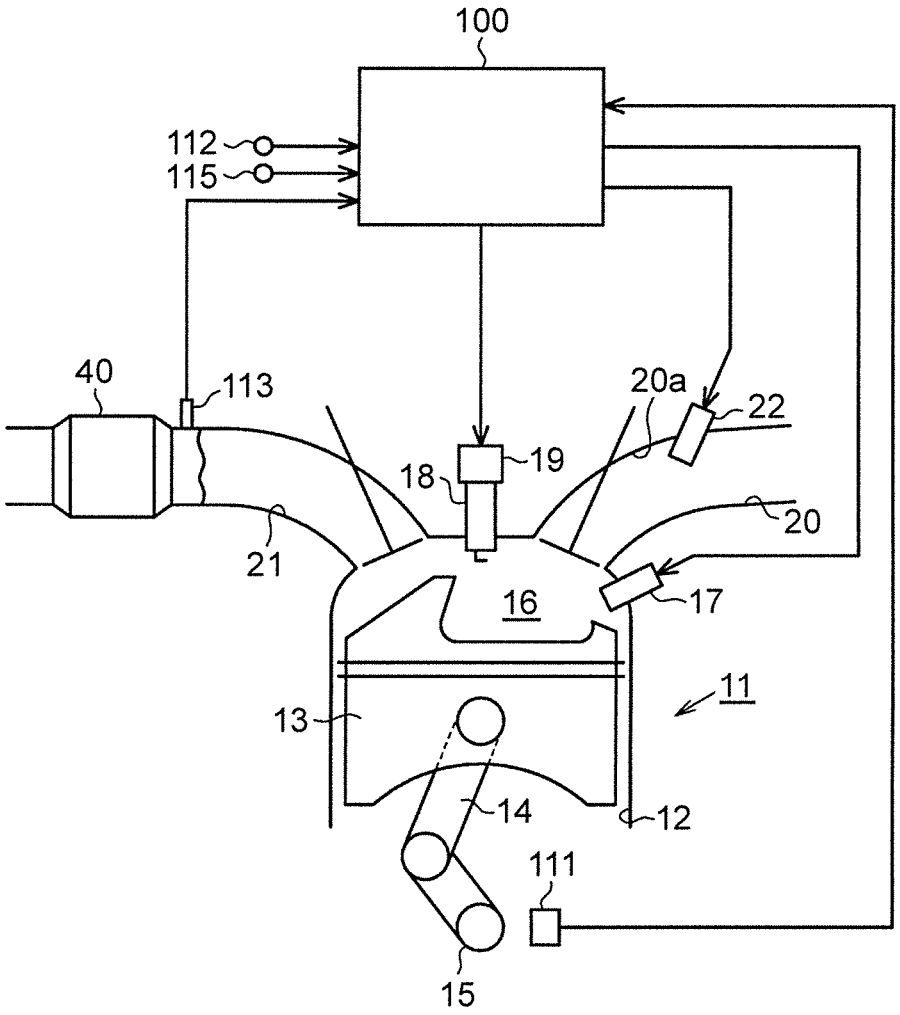
FIG. 1 is a configuration view that shows a control apparatus that is one embodiment of the control apparatus for an internal combustion engine and an internal combustion engine that is controlled by the control apparatus.

Hereinafter, an example embodiment of the control apparatus for an internal combustion engine will be described with reference to FIG. 1 to FIG. 5. FIG. 1 shows an electronic control unit 100 that is the control apparatus for an internal combustion engine according to the present embodiment and an internal combustion engine 11 that is controlled by the electronic control unit 100. As shown in FIG. 1, the internal combustion engine 11 is a multi-cylinder internal combustion engine having a plurality of cylinders 12. A piston 13 is provided in each cylinder 12. These pistons 13 are coupled to a crankshaft 15 via connecting rods 14. The crankshaft 15 is an output shaft of the internal combustion engine 11. The reciprocating motion of each piston 13 is converted to the rotational motion of the crankshaft 15 by a corresponding one of the connecting rods 14. The rotation speed of the crankshaft 15 is detected by a crank position sensor 111.

An upward space on the piston 13 within each cylinder 12 serves as a combustion chamber 16. The internal combustion engine 11 includes cylinder injection valves 17. Each of the cylinder injection valves 17 directly injects fuel into a corresponding one of the combustion chambers 16, and serves as a second injection valve.

Predetermined high-pressure fuel is supplied to the cylinder injection valves 17 via a fuel supply mechanism. As the cylinder injection valve 17 is activated, fuel is directly supplied to the corresponding combustion chamber 16.

An ignition plug 18 is installed in each combustion chamber 16. The ignition plug 18 ignites air-fuel mixture including fuel and air. The ignition timing of air-fuel mixture by the ignition plug 18 is adjusted by an ignitor 19 provided on the top of the ignition plug 18 in the drawing.

An intake passage 20 and an exhaust passage 21 are connected to each combustion chamber 16. The internal combustion engine 11 includes port injection valves 22. Each of the port injection valves 22 injects fuel into a corresponding one of intake ports 20*a* that constitute the intake passage 20. That is, each port injection valve 22 corresponds to a first injection valve that injects fuel into the intake passage 20. Fuel having a predetermined pressure is supplied to each port injection valve 22 via a fuel supply mechanism. As the port injection valve 22 is activated, fuel is supplied into the corresponding intake port 20*a*, and the fuel and air are supplied into the corresponding combustion chamber 16.

A throttle valve is provided upstream of the port injection valves 22 in the intake passage 20. The throttle valve regulates an intake air amount that is the amount of air that is introduced into the combustion chambers 16. An air flow meter 112 is provided upstream of the throttle valve in the intake passage 20. The air flow meter 112 detects such an intake air amount.

An exhaust emission control apparatus 40 is provided downstream of the exhaust passage 21. The exhaust emission control apparatus 40 exercises purification function when the air-fuel ratio of air-fuel mixture falls within a predetermined range. An air-fuel ratio sensor 113 is provided upstream of the exhaust emission control apparatus 40 in the exhaust passage 21. The air-fuel ratio sensor 113 detects the concentration of oxygen in exhaust gas flowing through the exhaust passage 21. The air-fuel ratio of air-fuel mixture combusted in each combustion chamber 16 is allowed to be detected on the basis of the concentration of oxygen in exhaust gas, detected by the air-fuel ratio sensor 113.

As shown in FIG. 1, in addition to the crank position sensor 111, the air flow meter 112 and the air-fuel ratio sensor 113, an accelerator operation amount sensor 115, and the like, are electrically connected to the electronic control unit 100 that controls the internal combustion engine 11. The accelerator operation amount sensor 115 detects an accelerator operation amount that is an operation amount of an accelerator pedal by a driver of a vehicle. The electronic control unit 100 is configured to execute various controls, such as fuel injection control, on the basis of information detected by such various detection systems.

For example, the electronic control unit 100 determines an injection distribution ratio DI on the basis of an operating state of the internal combustion engine 11. The injection distribution ratio DI is obtained by dividing a fuel injection amount SP from one of the port injection valves 22 by a total amount SPD of fuel that is supplied into the corresponding cylinder 12. The total amount SPD of fuel that is supplied into the cylinder 12 is the sum of the fuel injection amount SP from one of the port injection valves 22 and the fuel injection amount SD from a corresponding one of the cylinder injection valves 17. When the injection distribution ratio DI is set to 1, the electronic control unit 100 does not cause the cylinder injection valve 17 to inject fuel and causes only the port injection valve 22 to inject fuel. When the injection distribution ratio DI is set to 0 (zero), the electronic control unit 100 does not cause the port injection valve 22 to inject fuel and causes only the cylinder injection valve 17 to inject fuel. When the injection distribution ratio DI is larger than 0 (zero) and smaller than 1, the electronic control unit 100 causes both the port injection valve 22 and the cylinder injection valve 17 to inject fuel.

Figure 2:
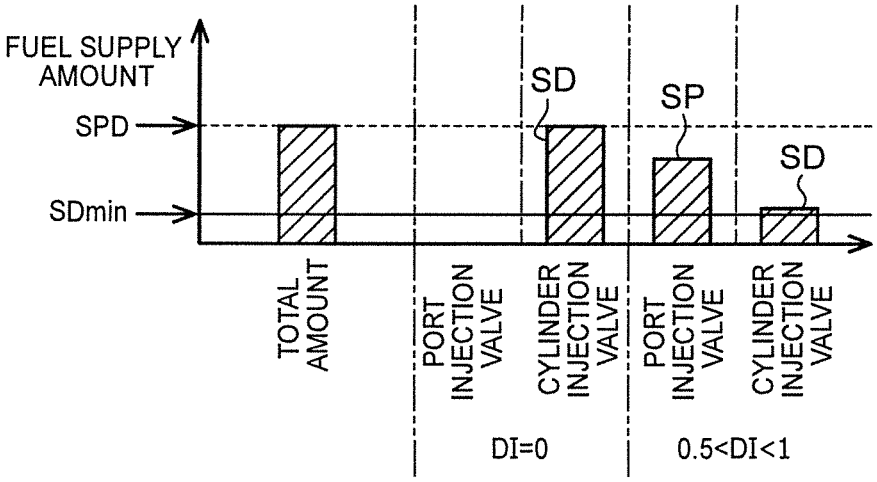
FIG. 2 is a graph that shows a state where fuel is distributively injected from first injection valves and second injection valves.
Figure 3:
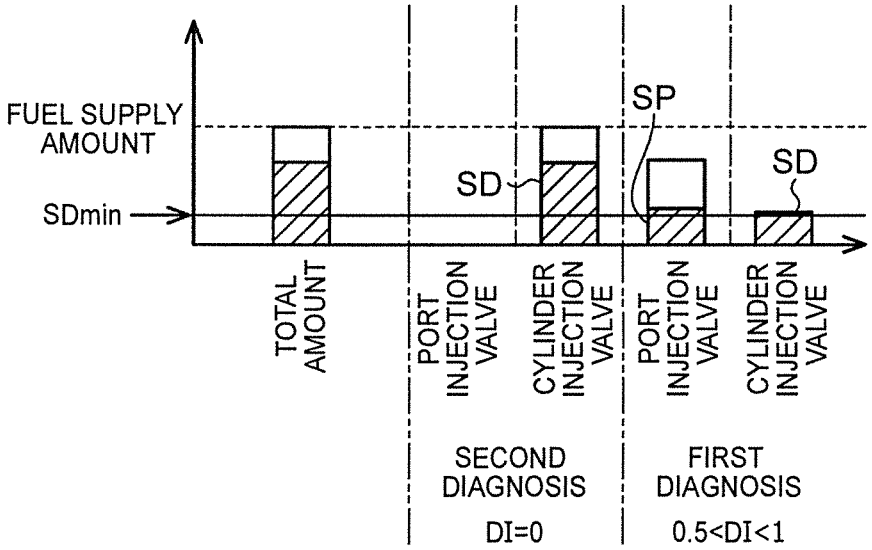
FIG. 3 is a graph that shows a state where the amount of fuel supplied into a target cylinder is reduced for diagnosis.

The electronic control unit 100 is configured to carry out an imbalance diagnosis for detecting the degree of inter-cylinder imbalance in the amount of fuel supplied into each cylinder. In FIG. 2, "TOTAL AMOUNT" denotes the total amount of fuel that is supplied into the cylinder, "DI=0" denotes a state where only the second injection valve injects fuel, and "0.5<DI<1" denotes a state where both the first injection valve and the second injection valve inject fuel. In FIG. 3, "TOTAL AMOUNT" denotes a state where the amount of fuel supplied into a target cylinder is reduced by a predetermined percentage, "DI=0" denotes a state where the fuel injection amount from the second injection valve is reduced, and "0.5<DI<1" denotes a state where the fuel injection amount from the first injection valve is reduced. As indicated by "TOTAL AMOUNT" in FIG. 2 and FIG. 3, in the imbalance diagnosis that is carried out by the electronic control unit 100, one of the cylinders is set as the target cylinder, and the total amount SPD of fuel that is supplied into the target cylinder is reduced. As the amount of fuel supplied into the target cylinder is reduced in this way, the rotation speed of the crankshaft 15 becomes lower in a combustion process of the target cylinder than in a combustion process of any other one of the cylinders. That is, within one cycle of the internal combustion engine 11, the rotation speed of the crankshaft 15 fluctuates.

At the time of the imbalance diagnosis, variations in the rotation speed of the crankshaft 15 within one cycle of the internal combustion engine 11 are observed. For example, a difference ΔNe between the maximum value and minimum value of the rotation speed in one cycle is obtained, and then a determination parameter Z based on the difference ΔNe is calculated. By using the determination parameter Z, a diagnosis of whether the degree of inter-cylinder imbalance in the amount of fuel supplied into each cylinder is large is carried out.

When the imbalance diagnosis is carried out by reducing the amount of fuel supplied into the target cylinder in this way, the amount of fuel supplied into the other cylinders, other than the target cylinder, may be increased such that the average of the air-fuel ratio is stoichiometric.

Incidentally, the internal combustion engine 11 shown in FIG. 1 includes both the port injection valve 22 and the cylinder injection valve 17 for each cylinder. For this reason, a first diagnosis and a second diagnosis are individually carried out as the imbalance diagnosis. In the first diagnosis, a diagnosis of whether there is a malfunction in fuel injection from the port injection valve 22 is carried out. In the second diagnosis, a diagnosis of whether there is a malfunction in fuel injection from the cylinder injection valve 17 is carried out. That is, the electronic control unit 100 carries out the first diagnosis and the second diagnosis.

As indicated by "DI=0" in FIG. 2 and FIG. 3, the second diagnosis is carried out in a state where the injection distribution ratio DI is set to 0 (zero) and fuel is injected from only the cylinder injection valve 17. The fuel injection amount SD from the cylinder injection valve 17 of the target cylinder is reduced by a predetermined percentage α from a required fuel injection amount. The required fuel injection amount is determined for each cylinder injection valve 17 on the basis of an operation mode, and the like, of the internal combustion engine 11. At this time, the fuel injection amount SD from the cylinder injection valve 17 of the target cylinder is reduced in a stepwise manner from the required fuel injection amount. In process in which the fuel injection amount SD is reduced, a diagnosis of whether there is a malfunction in fuel injection from the cylinder injection valve 17 is carried out.

As indicated by "0.5<DI<1" in FIG. 2 and FIG. 3, the first diagnosis is carried out in a state where the injection distribution ratio DI is larger than 0 (zero) and smaller than 1 and fuel is injected from both the cylinder injection valve 17 and the port injection valve 22. More specifically, the first diagnosis is carried out when the injection distribution ratio DI is larger than 0.5 and smaller than 1, that is, in a state where the fuel injection amount SP from the port injection valve 22 is larger than the fuel injection amount SD from the cylinder injection valve 17. When the first diagnosis is carried out in a situation that the injection distribution ratio DI is larger than 0 (zero) and smaller than 0.5, the fuel injection amount SP from the port injection valve 22 is increased with respect to the fuel injection amount SD from the cylinder injection valve 17 by setting the injection distribution ratio DI to a value larger than 0.5 and smaller than 1, and then the first diagnosis is carried out.

At the time of the first diagnosis, the fuel injection amount SD from the cylinder injection valve 17 of the target cylinder is not reduced from the required fuel injection amount, determined for the cylinder injection valve 17 on the basis of the operation mode, and the like, of the internal combustion engine 11. In addition, when the first diagnosis, the fuel injection amount SP from the port injection valve 22 of the target cylinder is reduced from the required fuel injection amount, determined for the port injection valve 22 on the basis of the operation mode, and the like, of the internal combustion engine 11. At this time, a corrected percentage α1 is obtained by correcting the predetermined percentage α to increase, and the fuel injection amount SP from the port injection valve 22 of the target cylinder is reduced by the corrected percentage α1 from the required fuel injection amount. The fuel injection amount SP from the port injection valve 22 of the target cylinder is reduced in a stepwise manner from the required fuel injection amount. In process in which the fuel injection amount SP is reduced, a diagnosis of whether there is a malfunction in fuel injection from the port injection valve 22 is carried out.

In the first diagnosis, the fuel injection amount from the cylinder injection valve 17 is not reduced. For this reason, while the first diagnosis is being carried out, a situation that the fuel injection amount from the cylinder injection valve 17 becomes smaller than or equal to a minimum injection amount SDmin in terms of the performance of the cylinder injection valve 17 is avoided.

The electronic control unit for an internal combustion engine according to the present embodiment sets the corrected percentage α1 to α value obtained by dividing the predetermined percentage α by the injection distribution ratio DI. Because the injection distribution ratio DI is larger than 0 (zero) and smaller than 1 at the time when the first diagnosis is carried out, the corrected percentage α1 is larger than the predetermined percentage α. In addition, as the injection distribution ratio DI approaches 0.5, the corrected percentage α1 is increased.

Next, a process routine that is executed by the electronic control unit 100 in order to carry out the imbalance diagnosis will be described with reference to the flowcharts shown in FIG. 4 and FIG. 5. The process routine is executed sequentially for each cylinder.

Figure 4:
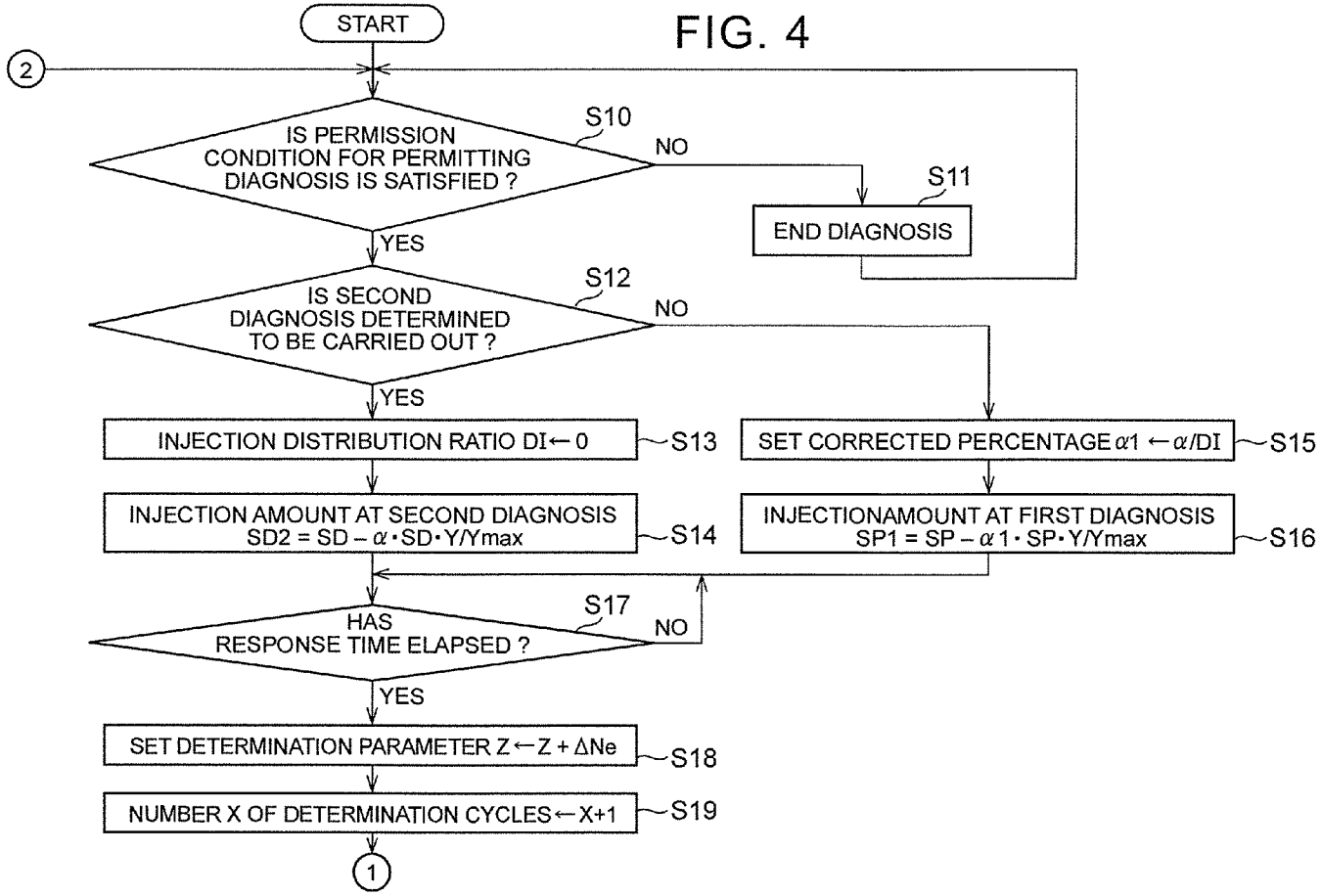
FIG. 4 is a first-half flowchart that illustrates a process routine that is executed by the control apparatus for carrying out a diagnosis of whether the degree of inter-cylinder imbalance in the amount of fuel supplied into each cylinder is large.
Figure 5:
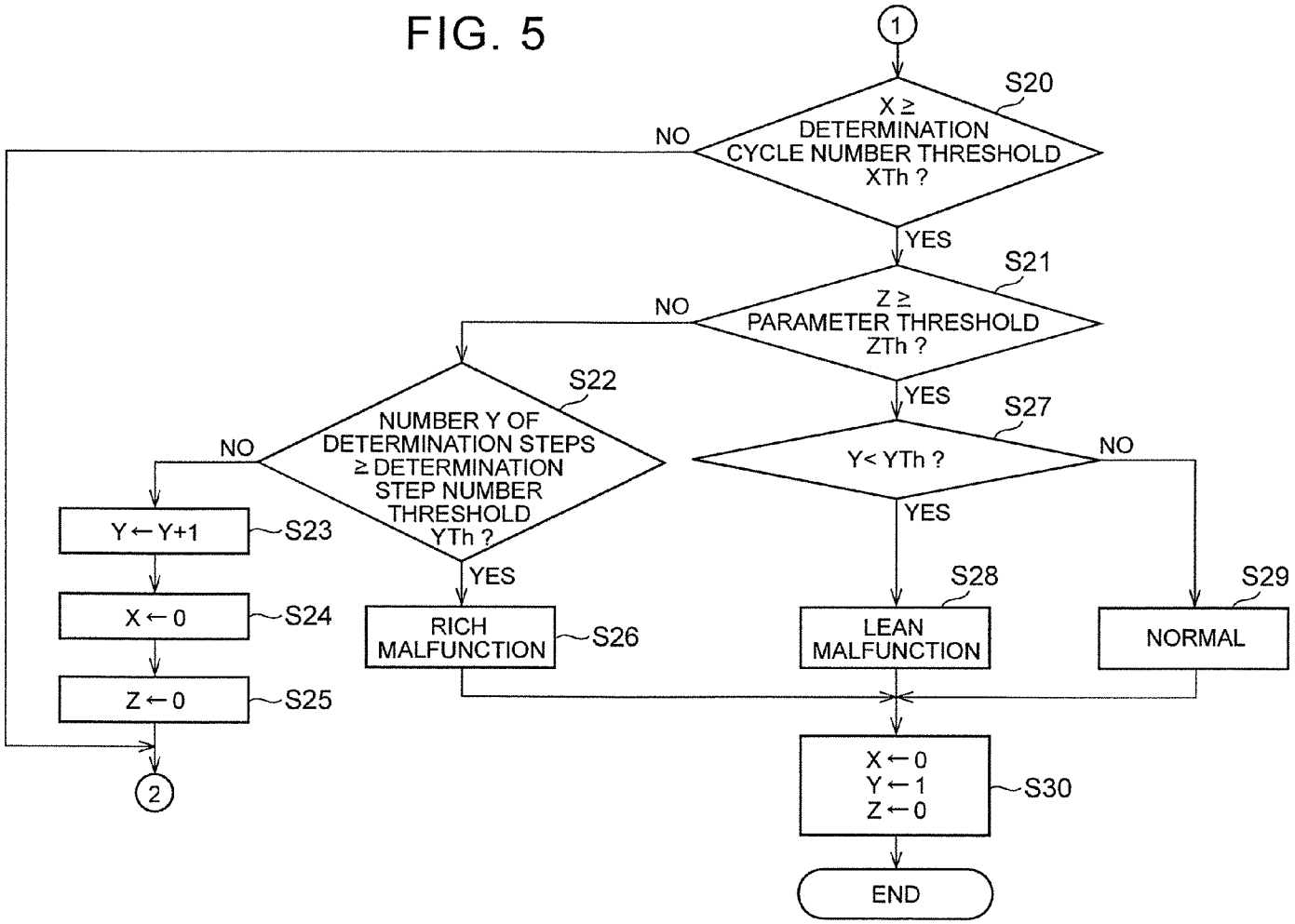
FIG. 5 is a second-half flowchart that illustrates the process routine that is executed by the control apparatus for carrying out a diagnosis of whether the degree of inter-cylinder imbalance in the amount of fuel supplied into each cylinder is large.
Figure 6:
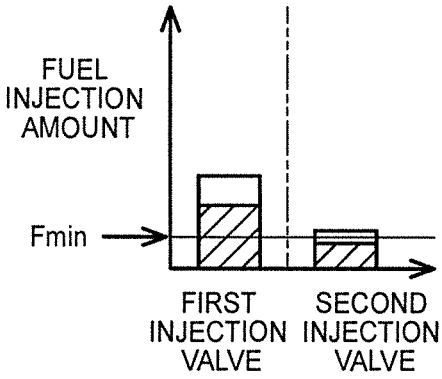
FIG. 6 RELATED ART
FIG. 6 is a graph that shows a state where, when a diagnosis is carried out in a state where fuel is injected from both a first injection valve and a second injection valve, both a fuel injection amount from the first injection valve and a fuel injection amount from the second injection valve are reduced by a predetermined percentage.

As shown in FIG. 4 and FIG. 5, in the process routine, the electronic control unit 100 determines whether a permission condition for permitting the imbalance diagnosis to be carried out is satisfied (step S10). For example, when the temperature of coolant flowing through a water jacket of the internal combustion engine is low during warm-up operation of the internal combustion engine 11, it may be determined that the permission condition is not satisfied. When the permission condition is not satisfied (NO in step S10), the electronic control unit 100 ends the imbalance diagnosis even when the imbalance diagnosis is being carried out (step S11), and executes the determination process of step S10 again. On the other hand, when the permission condition is satisfied (YES in step S10), the electronic control unit 100 determines whether a diagnosis to be carried out is the second diagnosis (step S12).

When it is determined to carry out the second diagnosis (YES in step S12), the electronic control unit 100 sets the injection distribution ratio DI to 0 (zero) (step S13). The electronic control unit 100 calculates an injection amount SD2 of fuel from the cylinder injection valve 17 when the second diagnosis (step S14), and causes the process to proceed to step S17 (described later). Where the injection amount (required injection amount) of fuel from the cylinder injection valve 17 before the injection amount is reduced through the second diagnosis is started is SD, the predetermined percentage is α, the number of determination steps is Y and the maximum number of determination steps is Ymax, the injection amount SD2 is calculated by using the following relational expression (1). That is, when the second diagnosis is carried out, the injection amount of fuel from the cylinder injection valve 17 is reduced with reference to the injection amount just before the start of the second diagnosis. The maximum number Ymax of determination steps is a value for prescribing the rate of reduction in injection amount when the imbalance diagnosis. The number Y of determination steps is a value that is incremented by 1 in step S23 (described later). Y/Ymax in the relational expression (1) is a value for prescribing the amount of reduction in injection amount per step at the time when the injection amount of fuel from the cylinder injection valve 17 is reduced in a stepwise manner.

$$SD2 = SD - \alpha \cdot SD \cdot \frac{Y}{Y\max} \tag{1}$$

On the other hand, when it is determined to carry out the first diagnosis in step S12 (NO), the electronic control unit 100 obtains the corrected percentage α1 by dividing the predetermined percentage α by the injection distribution ratio DI (step S15). The electronic control unit 100 calculates an injection amount SP1 of fuel from the port injection valve 22 when the first diagnosis (step S16), and causes the process to proceed to step S17 (described later). Where the injection amount (required injection amount) of fuel from the port injection valve 22 before the injection amount is reduced through the first diagnosis is started is SP, the number of determination steps is Y and the maximum number of determination steps is Ymax, the injection amount SP1 is calculated by using the following relational expression (2). That is, when the first diagnosis is carried out, the injection amount of fuel from the port injection valve 22 is reduced with reference to the injection amount just before the start of the first diagnosis. The maximum number Ymax of determination steps is a value for prescribing the rate of reduction in injection amount when the imbalance diagnosis. The number Y of determination steps is a value that is incremented by 1 in step S23 (described later). Y/Ymax in the relational expression (2) is a value for prescribing the amount of reduction in injection amount per step when reducing the injection amount of fuel from the port injection valve 22 in a stepwise manner.

$$SP1 = SP - \alpha 1 \cdot SP \cdot \frac{Y}{Y\max} \tag{2}$$

In step S17, the electronic control unit 100 determines whether an elapsed time from a point in time at which the injection amount is determined in step S14 or step S16 has reached a response time. A change in the rotation mode of the crankshaft 15 due to a reduction in the fuel injection amount from the injection valve appears after a lapse of a certain time. The response time is set in advance as such a time.

When the response time has not elapsed yet (NO in step S17), the electronic control unit 100 repeatedly executes the determination process of step S17. On the other hand, when the response time has already elapsed (YES in step S17), the electronic control unit 100 computes the determination parameter Z (step S18). For example, the electronic control unit 100 obtains a difference ΔNe between the maximum value and minimum value of the rotation speed of the crankshaft 15 in one cycle. The electronic control unit 100 adds the difference ΔNe to the determination parameter Z, and sets the sum for a new determination parameter Z. That is, the determination parameter Z is an integrated value of the difference ΔNe.

Subsequently, the electronic control unit 100 increments the number X of determination cycles by 1 (step S19). The electronic control unit 100 determines whether the updated number X of determination cycles is larger than or equal to a cycle number threshold XTh (step S20). The cycle number threshold XTh is set to a value larger than 1 and smaller than a determination step number threshold YTh (described later). That is, when the number X of determination cycles is smaller than the cycle number threshold XTh, it may be determined that the number of samples of the difference ΔNe is still small and a highly accurate diagnosis cannot be carried out yet.

For this reason, when the number X of determination cycles is smaller than the cycle number threshold XTh (NO in step S20), the electronic control unit 100 causes the process to proceed to step S10 (described above). On the other hand, when the number X of determination cycles is larger than or equal to the cycle number threshold XTh (YES in step S20), the electronic control unit 100 determines whether the calculated determination parameter Z is larger than or equal to a parameter threshold ZTh (step S21). The parameter threshold ZTh is a threshold for determining whether the amount of change in the determination parameter Z due to a reduction in the amount of fuel supplied into the corresponding combustion chamber 16 is large. For this reason, when the determination parameter Z is smaller than the parameter threshold ZTh, it may be determined that there may be a rich malfunction in the injection valve intended for diagnosis. The rich malfunction means a state where an actual injection amount from the injection valve intended for diagnosis is extremely larger than a required value.

When the determination parameter Z is smaller than the parameter threshold ZTh (NO in step S21), the electronic control unit 100 determines whether the number Y of determination steps is larger than or equal to the determination step number threshold YTh (step S22). The determination step number threshold YTh is set to a value equal to the maximum number Ymax of determination steps or a value smaller than the maximum number Ymax of determination steps. Even when the determination parameter Z is smaller than the parameter threshold ZTh but when the number Y of determination steps is smaller than the determination step number threshold YTh, it may be determined that there may be no rich malfunction in the injection valve intended for diagnosis. For this reason, when the number Y of determination steps is smaller than the determination step number threshold YTh (NO in step S22), the electronic control unit 100 increments the number Y of determination steps by 1 (step S23). Subsequently, the electronic control unit 100 resets the number X of determination cycles to 0 (zero) (step S24), resets the determination parameter Z to 0 (zero) (step S25), and causes the process to proceed to step S10 (described above).

On the other hand, when the number Y of determination steps is larger than or equal to the determination step number threshold YTh in step S22 (YES), the electronic control unit 100 diagnoses that there is a rich malfunction in the injection valve intended for diagnosis (step S26). The electronic control unit 100 causes the process to proceed to step S30 (described later).

On the other hand, when the determination parameter Z is larger than or equal to the parameter threshold ZTh in step S21 (YES), the electronic control unit 100 determines whether the number Y of determination steps is smaller than the determination step number threshold YTh (step S27). When the determination parameter Z is already larger than or equal to the parameter threshold ZTh although the number Y of determination steps is smaller than the determination step number threshold YTh, it may be diagnosed that there is a lean malfunction in the injection valve intended for diagnosis. The lean malfunction means a state where an actual injection amount from the injection valve intended for diagnosis is extremely smaller than a required value.

When the number Y of determination steps is smaller than the determination step number threshold YTh (YES in step S27), the electronic control unit 100 diagnoses that there is a lean malfunction in the injection valve intended for diagnosis (step S28), and causes the process to proceed to step S30 (described later). On the other hand, when the number Y of determination steps is larger than or equal to the determination step number threshold YTh (NO in step S27), the electronic control unit 100 diagnoses that the injection valve intended for diagnosis is normal (step S29), and causes the process to proceed to the next step S30.

In step S30, the electronic control unit 100 sets the number X of determination cycles to 0 (zero), sets the number Y of determination steps to 1, and further sets the determination parameter Z to 0 (zero). After that, the electronic control unit 100 ends the process routine.

According to the above-described configuration and operation, the following advantageous effects are obtained. In the first diagnosis, the fuel injection amount from the port injection valve 22 of the target cylinder is reduced, but the fuel injection amount from the cylinder injection valve 17 of the target cylinder is not reduced. For this reason, in carrying out the first diagnosis, it is possible to avoid a situation that the required fuel injection amount from the cylinder injection valve 17 becomes smaller than the minimum injection amount SDmin in terms of the performance of the cylinder injection valve 17. Therefore, it is possible to carry out a diagnosis of whether there is a malfunction in fuel injection from the port injection valve 22 without deteriorating the controllability of the cylinder injection valve 17.

In the first diagnosis, the fuel injection amount from the port injection valve 22 for the target cylinder is reduced by the corrected percentage $\alpha 1$ larger than the predetermined percentage $\alpha$. Thus, it is possible to increase the amount of reduction in the amount of fuel supplied into the target cylinder without reducing the fuel injection amount from the cylinder injection valve 17 of the target cylinder. As a result, it is possible to accurately carry out a diagnosis of whether there is a malfunction in fuel injection from the port injection valve 22.

In the present embodiment, the corrected percentage $\alpha 1$ is obtained by dividing the predetermined percentage $\alpha$ by the injection distribution ratio DI. For this reason, it is possible to bring the amount of reduction in the fuel injection amount from the port injection valve 22 resulting from the first diagnosis close to the product of the total amount SPD of fuel supplied into the cylinder 12 and the predetermined percentage $\alpha$.

Moreover, the first diagnosis is carried out in a state where the fuel injection amount from the port injection valve 22 is larger than the fuel injection amount from the cylinder injection valve 17. For this reason, in comparison with the case where the first diagnosis is carried out in a state where the fuel injection amount from the port injection valve 22 is smaller than the fuel injection amount from the cylinder injection valve 17, the amount of reduction in the amount of fuel supplied into the target cylinder when the first diagnosis increases. For this reason, it is possible to accurately carry out the first diagnosis.

As a method of obtaining the corrected percentage $\alpha 1$ by correcting the predetermined percentage $\alpha$ to increase, a method of setting the corrected percentage $\alpha 1$ by adding an offset value to the predetermined percentage $\alpha$ may be provided. In this case, in order to bring the amount of reduction in fuel injection amount from the cylinder injection valve 17 resulting from the first diagnosis close to a value obtained by integrating the predetermined percentage $\alpha$ with the total amount SPD of fuel that is supplied into the cylinder 12, an offset value for each operating situation, including a difference in the injection distribution ratio DI, needs to be prepared in advance. This increases the amount of storage of a memory of the electronic control unit 100. In this respect, in the present embodiment, the corrected percentage $\alpha 1$ is obtained by dividing the predetermined percentage $\alpha$ by the injection distribution ratio DI. For this reason, it is possible to accurately carry out a diagnosis of whether there is a malfunction in fuel injection from the port injection valve 22 while preventing or reducing an increase in the amount of storage of the memory.

The above-described embodiment may be modified into the following alternative embodiments. In the first diagnosis, a determination parameter Z may be calculated after the fuel injection amount SP from the port injection valve 22 is reduced by the corrected percentage $\alpha 1$, and the diagnosis may be carried out on the basis of the determination parameter Z.

Similarly, in the second diagnosis, a determination parameter Z may be calculated after the fuel injection amount SP from the cylinder injection valve 17 is reduced by the predetermined percentage $\alpha$, and the diagnosis may be carried out on the basis of the determination parameter Z.

The first diagnosis may be carried out in a state where the fuel injection amount SP from the port injection valve 22 is equal to the fuel injection amount SD from the cylinder injection valve 17. As long as it is possible to obtain the corrected percentage $\alpha 1$ by correcting the predetermined percentage $\alpha$ to increase, a computing method other than the method of dividing the predetermined percentage $\alpha$ by the injection distribution ratio DI may be employed. For example, a method of obtaining the corrected percentage $\alpha 1$ on the basis of a value obtained by adding an offset value to the predetermined percentage $\alpha$ may be employed.

In the first diagnosis, in a state where fuel is injected from both the port injection valve 22 and cylinder injection valve 17 of the target cylinder, the fuel injection amount from the cylinder injection valve 17 may be not reduced, while the fuel injection amount from the port injection valve 22 may be reduced by the predetermined percentage α. In this case as well, in carrying out the first diagnosis, the fuel injection amount from the cylinder injection valve 17 is not reduced, so it is possible to avoid a situation that the required fuel injection amount from the cylinder injection valve 17 becomes smaller than the minimum injection amount in terms of the performance of the cylinder injection valve 17. Therefore, it is possible to carry out a diagnosis of whether there is a malfunction in fuel injection from the port injection valve 22 without deteriorating the controllability of the cylinder injection valve 17.

What is claimed is:

1. A control apparatus for an internal combustion engine, the internal combustion engine including a plurality of cylinders, a first injection valve configured to inject fuel into an intake passage, and a second injection valve configured to inject fuel into a corresponding one of combustion chambers, the first injection valve and the second injection valve being provided for each cylinder, the control apparatus comprising an electronic control unit configured to:

carry out a first diagnosis and a second diagnosis in order to detect a degree of inter-cylinder imbalance in an amount of fuel supplied into each cylinder, the first injection valve of a target cylinder that is one of the plurality of cylinders being diagnosed through the first diagnosis, the second injection valve of the target cylinder being diagnosed through the second diagnosis;

control the first injection valve of the target cylinder and the second injection valve of the target cylinder such that an amount of fuel supplied into the target cylinder is reduced when detecting the degree of the inter-cylinder imbalance;

control the first injection valve of the target cylinder and the second injection valve of the target cylinder such that fuel is injected from both the first injection valve and the second injection valve when carrying out the first diagnosis;

control the first injection valve of the target cylinder and the second injection valve of the target cylinder such that a fuel injection amount from the second injection valve is not reduced and a fuel injection amount from the first injection valve is reduced when carrying out the first diagnosis;

control the first injection valve of the target cylinder such that fuel is not injected from the first injection valve when carrying out the second diagnosis; and control the second injection valve of the target cylinder such that the fuel injection amount from the second injection valve is reduced in a state where fuel is injected from the second injection valve when carrying out the second diagnosis.

2. The control apparatus according to claim 1, wherein the electronic control unit is configured to, in carrying out the second diagnosis, control the second injection valve of the target cylinder such that the fuel injection amount from the second injection valve is reduced by a predetermined percentage, and the electronic control unit is configured to, in carrying out the first diagnosis, control the first injection valve of the target cylinder and the second injection valve of the target cylinder such that the fuel injection amount from the second injection valve is not reduced and the fuel injection amount from the first injection valve is reduced by a corrected percentage obtained by correcting the predetermined percentage to increase.

3. The control apparatus according to claim 2, wherein the electronic control unit is configured to calculate an injection distribution ratio, the injection distribution ratio is obtained by dividing the fuel injection amount from the first injection valve by a sum of the fuel injection amount from the first injection valve and the fuel injection amount from the second injection valve, and the corrected percentage is obtained by dividing the predetermined percentage by the injection distribution ratio.

4. The control apparatus according to claim 1, wherein the electronic control unit is configured to carry out the first diagnosis when the fuel injection amount from the first injection valve is larger than the fuel injection amount from the second injection valve.

5. A control method for an internal combustion engine, the internal combustion engine including a plurality of cylinders, a first injection valve configured to inject fuel into an intake passage, and a second injection valve configured to inject fuel into a corresponding one of combustion chambers, the first injection valve and the second injection valve being provided for each cylinder, the control method comprising:

carrying out, by an electronic control unit, a first diagnosis and a second diagnosis in order to detect a degree of inter-cylinder imbalance in an amount of fuel supplied into each cylinder, the first injection valve of a target cylinder that is one of the plurality of cylinders being diagnosed through the first diagnosis, the second injection valve of the target cylinder being diagnosed through the second diagnosis;

controlling, by the electronic control unit, the first injection valve of the target cylinder and the second injection valve of the target cylinder such that an amount of fuel supplied into the target cylinder is reduced when detecting the degree of the inter-cylinder imbalance;

controlling, by the electronic control unit, the first injection valve of the target cylinder and the second injection valve of the target cylinder such that fuel is injected from both the first injection valve and the second injection valve when carrying out the first diagnosis;

controlling, by the electronic control unit, the first injection valve of the target cylinder and the second injection valve of the target cylinder such that a fuel injection amount from the second injection valve is not reduced and a fuel injection amount from the first injection valve is reduced when carrying out the first diagnosis;

controlling, by the electronic control unit, the first injection valve of the target cylinder such that fuel is not injected from the first injection valve when carrying out the second diagnosis; and controlling, by the electronic control unit, the second injection valve of the target cylinder such that the fuel injection amount from the second injection valve is reduced in a state where fuel is injected from the second injection valve when carrying out the second diagnosis.

* * * * *